US009884339B2

(12) United States Patent
Byrne et al.

(10) Patent No.: US 9,884,339 B2
(45) Date of Patent: Feb. 6, 2018

(54) ROLLER COVER AND ASSOCIATED CAMS

(71) Applicant: The Wooster Brush Company, Wooster, OH (US)

(72) Inventors: James M. Byrne, Wooster, OH (US); Richard K. Bukovitz, Orrville, OH (US); Lawrence A. Schwartz, Bay City, MI (US)

(73) Assignee: The Wooster Brush Company, Wooster, OH (US)

( * ) Notice: Subject to any disclaimer, the term of this patent is extended or adjusted under 35 U.S.C. 154(b) by 50 days.

(21) Appl. No.: 14/467,403

(22) Filed: Aug. 25, 2014

(65) Prior Publication Data

US 2015/0065322 A1 Mar. 5, 2015

Related U.S. Application Data

(60) Provisional application No. 61/872,195, filed on Aug. 30, 2013.

(51) Int. Cl.
*B05C 17/02* (2006.01)

(52) U.S. Cl.
CPC ..... *B05C 17/0245* (2013.01); *B05C 17/02* (2013.01); *B05C 17/021* (2013.01); *B05C 17/0207* (2013.01); *B05C 17/0225* (2013.01); *B05C 17/0242* (2013.01)

(58) Field of Classification Search
CPC ... B05C 17/02; B05C 17/0207; B05C 17/021; B05C 17/0222; B05C 17/0225; B05C 17/0242; B05C 17/0245; Y10T 29/49544; Y10T 29/49547; Y10T 29/49549; Y10T 29/49556
See application file for complete search history.

(56) References Cited

U.S. PATENT DOCUMENTS

| | | | | |
|---|---|---|---|---|
| 2,663,892 | A | 12/1953 | Schaefer | |
| 2,891,301 | A * | 6/1959 | Conklin | B05C 17/02 492/13 |
| 3,685,084 | A | 8/1972 | Bennett | |
| 4,599,762 | A | 7/1986 | Rigter | |
| 5,133,117 | A | 7/1992 | Lomasney | |
| 5,606,763 | A | 3/1997 | South et al. | |
| 6,308,370 | B1 | 10/2001 | Southby | |
| 6,347,426 | B1 * | 2/2002 | Weiss | B05C 17/02 15/230.11 |
| 2002/0042331 | A1 * | 4/2002 | Fortner | B05C 17/02 492/13 |

FOREIGN PATENT DOCUMENTS

| | | |
|---|---|---|
| EP | 0765693 | 2/1997 |

* cited by examiner

*Primary Examiner* — Christopher Besler
(74) *Attorney, Agent, or Firm* — Renner, Otto, Boisselle & Sklar, LLP

(57) ABSTRACT

A roller cover and associated pair of cams attachable to opposite ends of the roller cover. Each of the cams has an outer diameter extending radially outwardly beyond an outer diameter of the roller cover a predetermined distance for maintaining the outer diameter of the roller cover a corresponding distance from the surface being coated during rotational movement of the roller cover over the surface to act as a thickness gauge for the coating being applied to the surface.

15 Claims, 2 Drawing Sheets

ROLLER COVER AND ASSOCIATED CAMS

CROSS-REFERENCE TO RELATED APPLICATION

This application claims the benefit of U.S. Provisional Application Ser. No. 61/872,195, filed Aug. 30, 2013, the entire disclosure of which is incorporated herein by reference.

FIELD OF THE INVENTION

This invention related generally to a roller cover and associated cams that act as a thickness gauge for a spreadable coating when applied to a surface using the roller cover.

BACKGROUND

There are quite a few different known types of devices including roller covers that are useful in applying a substantially uniform thickness of a spreadable polymer coating such as an epoxy or other type polymer to surfaces of various types including countertops and floors and the like.

However, there is an ongoing need for a device that can be used more effectively to apply spreadable coatings of a desired thickness to countertops and floorings of different types.

SUMMARY OF THE INVENTION

In accordance with one aspect of the invention, different diameter cams may be attached to opposite ends of a roller cover for maintaining the outer diameter of the roller cover a predetermined distance from a surface to which a spreadable coating is to be applied during rotational movement of the roller cover over the surface to act as a thickness gauge for the coating being applied to the surface.

In accordance with another aspect of the invention, each of the cams has a bearing support for rotatably supporting opposite ends of the roller cover on a shaft portion of a roller frame.

In accordance with another aspect of the invention, the outer diameter of each of the cams has an outer peripheral edge containing a plurality of circumferentially spaced notches to reduce the amount of surface contact of the cams with the surface being coated during rotational movement of the roller cover over the surface.

In accordance with another aspect of the invention, different pairs of the cams having different outer diameters all greater than the outer diameter of the outer covering of the roller cover may be interchangeable to provide different thickness gauges for the coating to be applied to the surface during rotational movement of the roller cover over the surface.

In accordance with another aspect of the invention, the different diameter pairs of cams may be color coded to indicate different coating thicknesses the different diameter pairs of cams will leave on the surface during rotational movement of the roller cover over the surface.

These and other objects, advantages, features and aspects of the present invention will become apparent as the following description proceeds.

DETAILED DESCRIPTION

Figure 1:
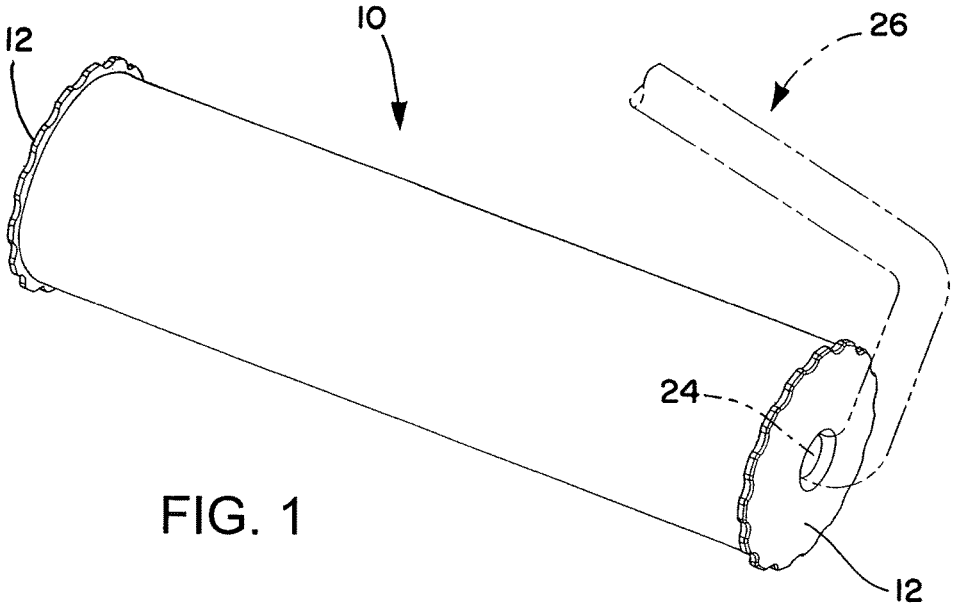
FIG. 1 is a schematic perspective view of an exemplary roller cover and associated cams shown mounted on the shaft portion of a paint roller frame.
Figure 2:
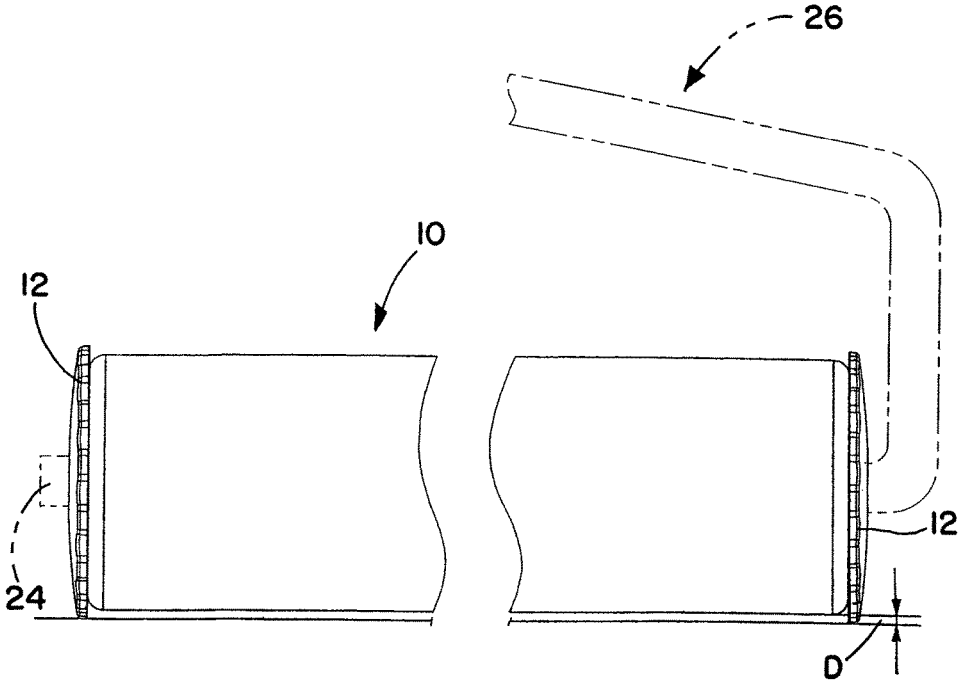
FIG. 2 is an enlarged fragmentary side elevation view of the roller cover and associated cams of FIG. 1.
Figure 4:
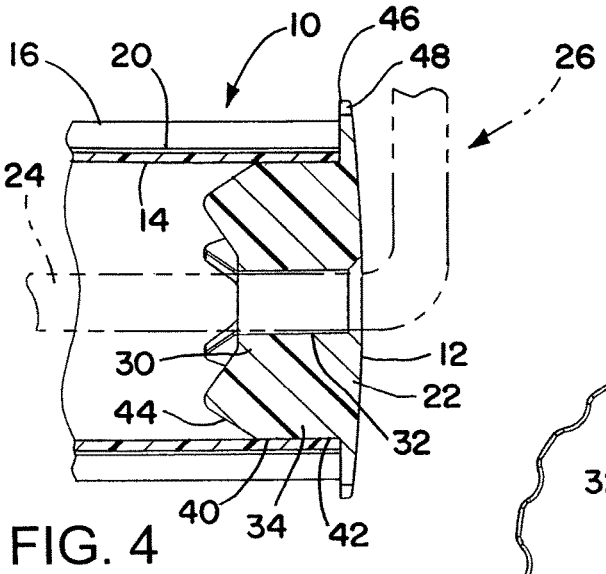
FIG. 4 is a fragmentary longitudinal section through the right end of the roller cover and associated cam of FIG. 3 taken on the plane of the line 4-4 thereof.
Figure 3:
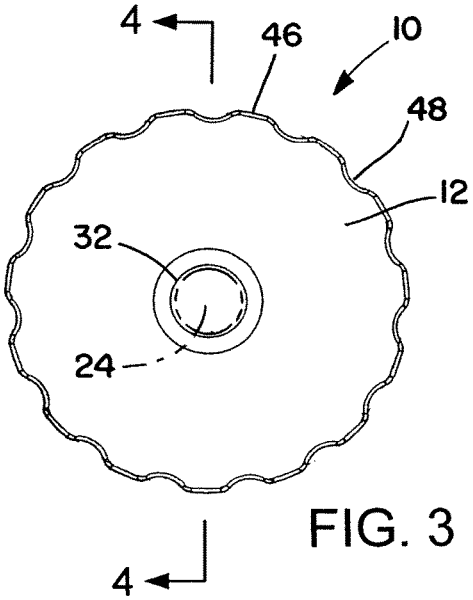
FIG. 3 is an enlarged right end view of the roller cover and associated cam of FIG. 2.

Referring now in detail to the drawings, and initially to FIGS. 1-4, there is shown an exemplary embodiment of a roller cover 10 and associated pair of cams 12 of the present invention attached to opposite ends of the roller cover. The cams act as a thickness gauge when the roller cover is used to apply a suitable spreadable polymer coating such as epoxy or other polymer of a desired thickness to surfaces of various types including but not limited to countertops and flooring as described hereafter.

The roller cover 10 may be of any suitable type. As seen in the non-limiting example shown in FIG. 4, the roller cover comprises a hollow tubular core 14 to which a suitable outer covering 16 is suitably secured. The core 14 may be made for example of any suitable crystalline or semi-crystalline polyolefin polymer such as natural and filled polypropylene and high density polyethylene. The outer covering 16 may be a conventional roller fabric having for example a heavy open weave thermoplastic backing woven into the fabric to allow for a superior mechanical bond between the fabric backing and a bonding film 20 used to adhere the outer covering to the core. The fabric pile or nap of the outer covering may be made of different materials or blends and of different heights depending on the particular application.

Figure 5:
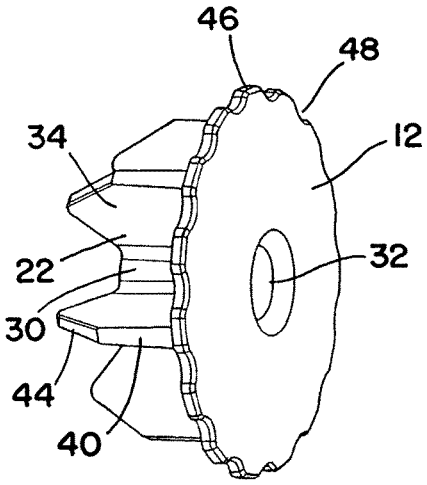
FIG. 5 is an enlarged perspective view of the cam of FIG. 4 as seen from the right end thereof.
Figure 7:
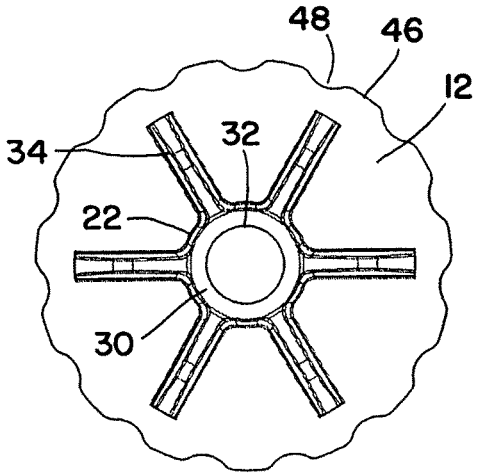
FIG. 7 is a left end view of the cam of FIG. 5.
Figure 6:
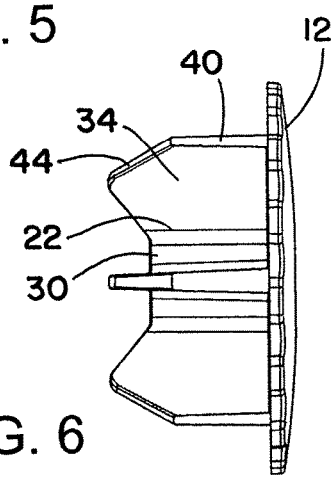
FIG. 6 is a side view of the cam of FIG. 5.

A pair of the cams 12 preferably of substantially the same size and shape may be attached to opposite ends of the roller cover 10 in any suitable manner. In the non-limiting example disclosed herein, each of the cams 12 has a bearing support 22 for rotatably supporting opposite ends of the roller cover 10 on a shaft portion 24 of a roller frame 26 (shown in phantom lines in FIGS. 1-4). As can be seen in FIGS. 4-7, the bearing support 22 of each of the cams comprises a central hub portion 30 containing an axial bore 32 for rotatably mounting the roller cover 10 and associated cams on the shaft portion 24 of the roller frame 26. Extending radially outwardly from the central hub portion of each of the cams are a plurality of circumferentially spaced ribs 34. Each of the ribs has an axially extending outer edge 40 that is frictionally engageable with the inner diameter of the opposite open ends 42 of the hollow core 14 for frictionally attaching the cams to the ends of the roller cover. Also the ribs may have radially and axially inwardly angled inner end portions 44 as shown for ease of insertion of the ribs into the opposite open ends of the hollow core.

When the pair of cams 12 are suitably attached to opposite ends of the roller cover 10, the outer diameter of each of the pair of cams 12 extends radially outwardly beyond the outer diameter of the outer covering 16 of the roller cover a predetermined distance D (see FIG. 2) for maintaining the outer diameter of the outer covering a corresponding distance from the surface being coated during rotational movement of the roller cover over the surface to act as a thickness gauge for the coating being applied to the surface.

In the exemplary embodiment disclosed herein, the outer diameter of each of the cams has an outer peripheral edge 46 containing a plurality of circumferentially spaced notches 48 to reduce the amount of surface contact of the outer diameter edge with the surface being coated during rotational movement of the roller cover over the surface. This has the advantage that the notched outer diameter edge of the cams will form relatively small dimples in the spreadable coating during rotational movement of the roller cover over the surface that will more readily fill in than if there were no notches in the outer diameter edge of the cams. Although the number and size of the notches may be varied as desired, there are preferably approximately ten to twenty substantially uniformly spaced notches in the outer diameter edge of the cams and more preferably approximately fifteen substantially uniformly spaced notches therein. Also each of the notches preferably has a radius of between approximately 0.10 inch and approximately 0.15 inch, and more preferably approximately 0.12 inch.

A plurality of different pairs of the cams 12 having different outer diameters all greater than the outer diameter of the outer covering of the roller cover may be interchangeable to provide different thickness gauges for the coating to be applied to the surface during rotational movement of the roller cover over the surface. Moreover, the different diameter pairs of cams may be color coded to indicate different coating thicknesses the respective pairs of different diameter cams will leave on the surface during rotational movement of the roller cover over the surface. By way of example, one pair of color coded roller cams (e.g., a yellow color coding) may have an outer radius of approximately four to six mils greater than the outer radius of the roller cover used to deposit a four to six mil coating layer on a surface; another pair of color coded roller cams (e.g., a green color coding) may have an outer radius of approximately fourteen to sixteen mils, greater than the outer radius of the roller cover used to deposit a fourteen to sixteen mil coating layer on a surface; and another pair of color coded roller cams (e.g., a red color coding) may have an outer radius of approximately twenty-four to twenty-six mils greater than the outer radius of the roller cover used to deposit a twenty-four to twenty-six mil layer coating on a surface.

Although the invention has been shown and described with respect to a certain embodiment, equivalent alterations and modifications will become apparent upon the reading and understanding of the specification. In particular, with regard to the various functions performed by the above-described components, the terms used to describe such components are intended to correspond, unless otherwise indicated, to any component which performs the specified function of the described component (e.g., that is functionally equivalent), even though not structurally equivalent to the exemplary embodiment. In addition, while a particular feature may have been disclosed with respect to only one embodiment, such feature may be combined with one or more other features as may be desired or advantageous for any given or particular application.

What is claimed is:

1. A spreadable coating applicator comprising a roller cover and a pair of cams that act as a thickness gauge when the roller cover is used to apply a spreadable coating to various surfaces, the roller cover including a hollow core externally surrounded by an outer covering that is bonded to the hollow core, the outer covering forming a radially outermost surface of the roller cover defining an outer diameter of the roller cover, wherein the radially outermost surface is configured for transferring a spreadable coating onto an external surface, and the pair of cams being attached to opposite ends of the roller cover, each of the cams having an outer diameter extending radially outwardly beyond an outer diameter of the outer covering a predetermined distance for maintaining the outer diameter of the outer covering a corresponding distance from the surface being coated during rotational movement of the roller cover over the surface to act as a thickness gauge for the coating being applied to the surface, and wherein the outer diameter of the pair of cams forms a radially outermost surface of the spreadable coating applicator.

2. The spreadable coating applicator of claim 1, wherein each of the cams has a bearing support for rotatably supporting the opposite ends of the roller cover on a shaft portion of a roller frame.

3. The spreadable coating applicator of claim 2, wherein the bearing support of each of the cams comprises a central hub portion extending axially inwardly from the respective cams into opposite open ends of the hollow core, the central hub portion of each of the cams containing an axial bore for rotatably mounting the roller cover and associated cams on the shaft portion of the roller frame.

4. The spreadable coating applicator of claim 3, wherein the central hub portion of each of the cams has a plurality of circumferentially spaced radially outwardly extending ribs, the ribs having axially inwardly extending outer edges that frictionally engage an inner diameter of the opposite open ends of the hollow core for frictionally attaching the cams to the opposite open ends of the hollow core.

5. The spreadable coating applicator of claim 4, wherein the ribs have radially and axially inwardly angled inner end portions for ease of insertion of the ribs into the opposite open ends of the hollow core.

6. The spreadable coating applicator of claim 1, wherein the outer diameter of each of the cams has an outer peripheral edge containing a plurality of circumferentially spaced notches to reduce an amount of surface contact of the cams with the surface being coated during rotational movement of the roller cover over the surface.

7. The spreadable coating applicator of claim 6, wherein the notches have a radius of between approximately 0.10 inch and approximately 0.15 inch.

8. The spreadable coating applicator of claim 6, wherein there are approximately 10 to 20 substantially uniformly spaced notches in the outer peripheral edge of the cams.

9. The spreadable coating applicator of claim 1, wherein a plurality of pairs of the cams having different outer diameters all greater than the outer diameter of the outer covering of the roller cover are interchangeable to provide different thickness gauges for the coating to be applied to the surface during rotational movement of the roller cover over the surface.

10. The spreadable coating applicator of claim 9, wherein the different diameter pairs of cams are color coded to indicate different coating thicknesses the respective pairs of different diameter cams will leave on the surface during rotational movement of the roller cover over the surface.

11. A spreadable coating applicator comprising a roller cover and associated cams that act as a thickness gauge when the roller cover is used to apply a spreadable coating to various surfaces, the roller cover including a hollow core externally surrounded by an outer covering that is bonded to the hollow core, the outer covering forming a radially outermost surface of the roller cover defining an outer diameter of the roller cover, wherein the radially outermost surface is configured for transferring a spreadable coating onto an external surface, and the associated cams including a cam at each end of the roller cover, each of the cams having an outer diameter extending radially outwardly beyond an outer diameter of the outer covering a predetermined distance for maintaining the outer diameter of the outer covering a corresponding distance from the surface being coated during rotational movement of the roller cover over the surface to act as a thickness gauge for the coating being applied to the surface, wherein the outer diameter of the pair of cams forms a radially outermost surface of the spreadable coating applicator, and wherein the outer diameter of each of the cams has an outer peripheral edge containing a plurality of circumferentially spaced notches to reduce the amount of surface contact of the cams with the surface being coated during rotational movement of the roller cover over the surface.

12. The spreadable coating applicator of claim 11, wherein a plurality of pairs of the cams having different outer diameters all greater than the outer diameter of the outer covering of the roller cover are interchangeable to provide different thickness gauges for the coating to be applied to the surface during rotational movement of the roller cover over the surface.

13. The spreadable coating applicator of claim 12, wherein the different diameter pairs of cams are color coded to indicate different coating thicknesses the respective pairs of different diameter cams will leave on the surface during rotational movement of the roller cover over the surface.

14. The spreadable coating applicator of claim 11, wherein the outer covering is a fabric.

15. The spreadable coating applicator of claim 1, wherein the outer covering is a fabric.

* * * * *